United States Patent [19]

Grewall

[11] Patent Number: 4,648,152

[45] Date of Patent: Mar. 10, 1987

[54] RETRACTABLE DOOR STOP

[76] Inventor: Harpal Grewall, P.O. Box 15, Site 12, SS1, Sudbury, Ontario, Canada

[21] Appl. No.: 818,392

[22] Filed: Jan. 13, 1986

Related U.S. Application Data

[63] Continuation-in-part of Ser. No. 706,251, Feb. 28, 1985, abandoned, which is a continuation of Ser. No. 514,058, Jul. 15, 1983, abandoned.

[30] Foreign Application Priority Data

Mar. 18, 1983 [CA] Canada ..... 423977

[51] Int. Cl.[4] ..... E05F 5/04

[52] U.S. Cl. ..... 16/82; 16/347

[58] Field of Search ..... 16/82, 83, 86 R, 86 A, 16/86 B, 86 C, 86, 223, 347

[56] References Cited

U.S. PATENT DOCUMENTS 628,850 7/1899 Rathvon ..... 16/86 A
1,263,930 4/1918 Rixson ..... 16/347
2,712,150 7/1955 Hodges .
2,889,571 6/1959 Moore .
3,137,025 6/1964 Howard ..... 16/83
4,310,947 1/1982 Salerno .

FOREIGN PATENT DOCUMENTS 10031 of 1898 United Kingdom ..... 16/347

*Primary Examiner*—Fred Silverberg
*Attorney, Agent, or Firm*—Browdy and Neimark

[57] ABSTRACT

A retractable door stop comprising a body secured to a hinge assembly is described. The door stop is adapted to be pivotally secured to a door jamb on which a door is pivotally mounted. In use, the door stop is pivotable about an axis spaced from the pivot axis of the door and generally parallel thereto between an inoperative and an operative position. In the operative position of the body of the door stop engages the door at the end side to which the door hinges are secured and which abuts the door jamb when the door is closed so as to keep the door in an open position.

3 Claims, 11 Drawing Figures

RETRACTABLE DOOR STOP

This application is a continuation-in-part of application Ser. No. 06/706,251, filed Feb. 28, 1985, now abandoned; wherein Ser. No. 706,251 is a continuation of application Ser. No. 06/514,058, filed July 15, 1983, now abandoned.

This invention relates to a door stop for holding doors which are pivotally mounted in a door frame in an open position.

In many cases, it is important that a door can be held in a wide open position to allow unimpeded passage through the doorway. Desirably, door stops used for this purpose are easy to install and easy to use. Moreover, it is important that the door stop allows the door to be fully open and that it does not protude into the doorway. Also the door stop should be inexpensive to manufacture.

Devices for holding doors open are known. Such devices include arrangements which are attached to the bottom of a door and which can be slipped downwardly causing a rubber stop or the like to contact the floor, cause friction and hold the door in an open position. It is obvious that the efficiency of a door stop of this kind depends greatly on the properties of the floor surface. Other door stop devices, such as the device disclosed in U.S. Pat. No. 2,712,150 to Hodges, are intended to retard slamming of the door, but do not retain the door in a wide open position. Doorstops specifically designed for swinging and sliding doors have also been described, for example, in U.S. Pat. No. 2,889,571 to Moor and U.S. Pat. No. 4,310,947 to Salerno.

The present invention is intended to provide a door stop of relatively simple construction which is easy to secure to a door jamb on which a door is pivotally mounted. When installed, the door stop can be pivoted into an operative position in which it retains the door in a wide open position and allows substantially unimpeded passage through the doorway. Pivoting of the inventive door stop away from the door into an inoperative position allows partial or complete shutting of the door.

Accordingly, in one aspect of the present invention there is provided a rectractable door stop adapted to be hingedly secured to a door jamb for positively locating a pivotally mounted door, which is hinged to a door jamb, in an open position. The door stop comprises a body secured to a hinge assembly which includes means for mounting the hinge assembly on the door jamb. When the door stop is mounted on a door jamb, the body is pivotable about an axis which is spaced from the pivot axis of the door and which is generally parallel thereto between an inoperative and an operative position. In the operative position the body engages the door at the end side of the door to which the door hinges and secured and which abuts the door jamb when the door is closed, thereby keeping the door in an open position. Generally the pivot axis of the door stop is sufficiently spaced from the pivot axis of the door to allow the door to be closed when the body is pivoted into its inoperative position.

In a second aspect of the invention there is provided the inventive door stop hingedly secured to a door jamb in a door frame with a pivotally mounted door hinged to the door jamb.

The invention will now be described in more detail by way of example only and with reference to the accompanying drawings in which FIG. 1 is a perspective view of one embodiment of a door stop according to the invention;

Figure 1:
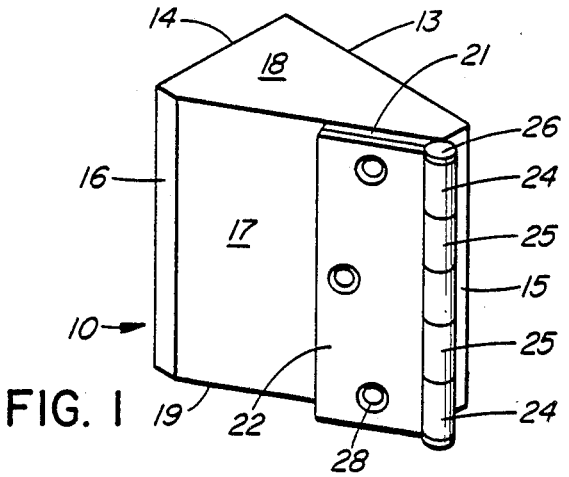
Figure 2:
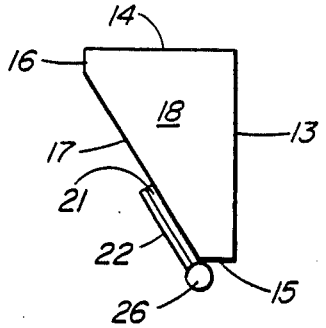
FIG. 2 is an end plan view of the door stop of FIG. 1.

Referring to FIGS. 1 and 2 the door stop according to the invention comprises a body 10 in the shape of a prism. In cross section the body is a generally right-angled triangle. The more acute corner of the triangle is cut off to facilitate handling of the door stop and to avoid sharp corners. The second acute corner of the body may also be cut off or flattened. Accordingly, the body has two side surfaces 13 and 14 extending at right angle to each other, a narrow side surface 15 adjacent side 13, a second narrow side surface 16 adjacent side 14 and the hypotenuse side surface 17 extending from side 15 to side 16. Additionally, the body has two end surfaces 18 and 19, respectively.

A hinge assembly is mounted on body 10. The assembly comprises two hinge plates 21 and 22. In the embodiment illustrated each hinge plate is provided with a pair of hinge fingers 24 and 25 adjacent one of the edges of the plates. Hinge fingers 24, 25 are arranged in such a way that they interleave. A hinge pin 26 extends through the apertures in the hinge fingers allowing the hinge plate to pivot about the hinge pin. Each hinge plate is further provided with a plurality of holes 28 for receiving screws. Hinge plate 21 is secured to surface 17 of body 10 such that the hinge fingers protrude beyond surface 17 and hinge plate 22 can pivot about pin 26 between a position parallel to plate 21 (as shown in FIGS. 1 and 2) and a position roughly parallel to surface 15 of body 10.

Figure 3:
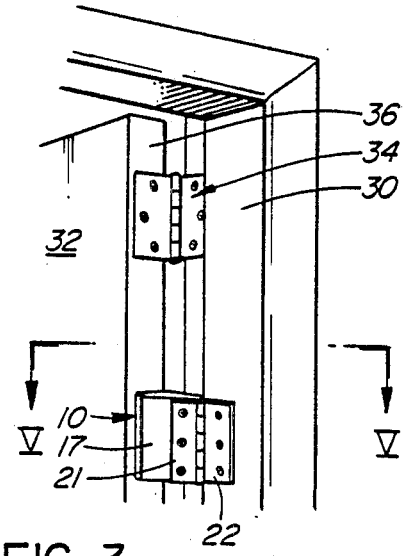
FIG. 3 is a perspective partial view of a door and door frame to which the door stop of FIG. 1 is mounted, showing the door stop in the operative position.
Figure 4:
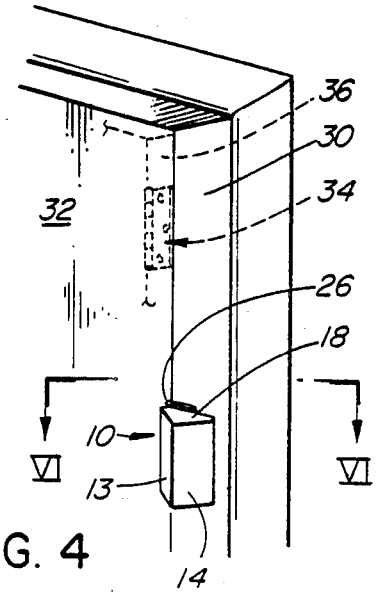
FIG. 4 is a perspective partial view of a door and door frame to which the door stop of FIG. 1 is mounted, showing the door stop in the inoperative position.

To install the door stop, hinge plate 22 is secured to door jamb 30 of a generally rectangular door frame assembly to which door panel 32, having a first face an opposing face, two opposed top and bottom faces, a hinge edge and a latch edge, is connected via hinges 34 (FIGS. 3 and 4). The hinges 34 are secured to the door jamb at end side (hinge edge) 36 of door panel 32 in the usual way. As usual, a latch hole for receiving a latch on the latch edge of the door panel (opposite the hinge edge) is on the opposing door jamb (latch side) of the door frame. The door stop is placed at a suitable height in order to be readily accessible. A very convenient arrangement is the placement of the door stop about halfway between two door hinges.

In the embodiment shown in FIGS. 3 to 6, plate 22 is positioned on the door jamb 30 in such a manner that the pivot axis of the door stop (the second axis) is parallel to the pivot axis of the door panel (the first axis) and that surface 14 of body 10 (door engaging member) can be pivoted into a position in which it abuts and extends substantially parallel to end side 36 of the door panel, when the door panel is substantially fully opened. At the same time, it has to be taken care that the hinge fingers are sufficiently spaced from the door hinges to allow the door panel to be shut. That means, that the hinge assembly of the door stop is spaced from the hinges of the door by at least the width of end side 36 of the door. Screws or the like are inserted through holes 28 in plate 22 and the door stop is fixed to the door jamb. Preferably, the holes in the hinge plates are countersunk such that flat headed screws, when inserted, are flush with the plates.

Figure 5:
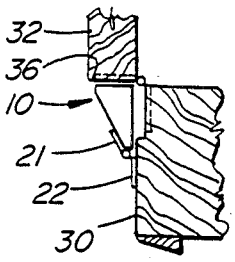
FIG. 5 is a cross-sectional view along line V—V in FIG. 3.
Figure 6:
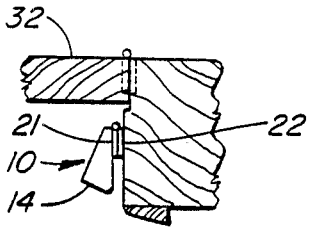
FIG. 6 is a cross-sectional view along line VI—VI in FIG.4.
Figure 7:
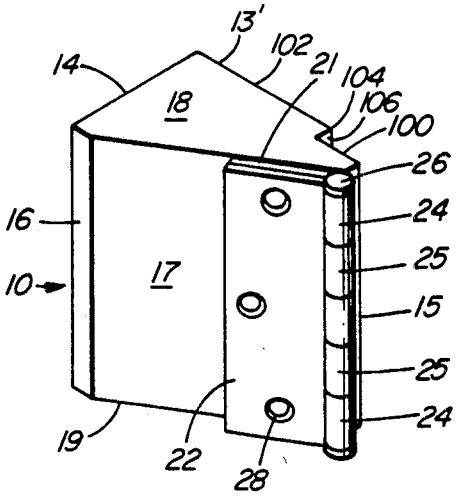
FIG. 7 is a perspective view of a door stop second embodiment according to the invention.
Figure 8:
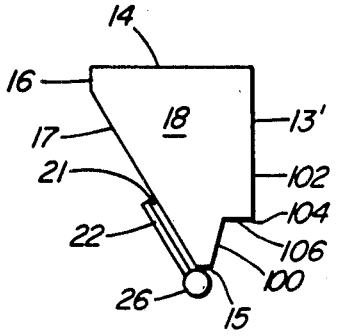
FIG. 8 is an end plan view of the door stop of FIG. 7.
Figure 9:
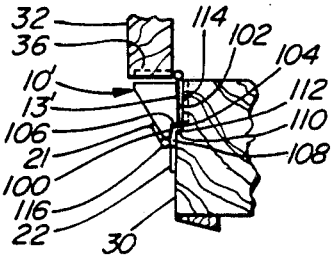
FIG. 9 is a cross-sectional view of a second embodiment of the present invention.
Figure 10:
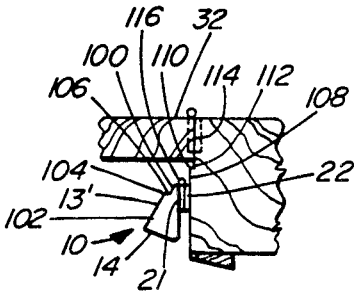
FIG. 10 is another cross-sectional view of a second embodiment of the present invention.

In use the door stop can be moved between an operative position in which the stop keeps the door in wide open position (see FIGS. 3 and 5) and an inoperative position in which the door can be closed (see FIGS. 4 and 6). As shown in FIGS. 3 and 5, in the fully open position, end side 36 is at an at least approximately 90° angle relative to the hinge side jamb 30. When the door is to be kept open, the door stop is moved into its operative position, that means, body 10 is pivoted away from the door jamb until a surface section in this embodiment side 14, abuts end side 36 of door 32 and side 13 extends substantially parallel to door jamb 30 as shown in FIGS. 3 and 5. In this position body 10 counteracts any attempts to close the door. When it is desired to shut the door stop is moved out of the operative position. To move the stop into the inoperative position shown in FIGS. 4 and 6, body 10 is pivoted until side 17 extends substantially parallel to the door jamb and hinge plate 22 overlines hinge plate 21.

Body 10' may be made of wood or of other suitable materials such as plastic or metal. In some cases it may be advantageous for reasons of appearance, that the body be made of the same material as the door and door frame, so as to blend with the door and frame.

FIGS. 7–11 show an improved embodiment of the present invention. Side 13' includes a recessed portion 100 and a non-recessed portion 102. Edge 104 is defined by the intersection of non-recessed portion 102 with a sidewall 106 connecting non-recessed portion 102 with recessed portion 100. Sidewall 106 need not be flat, but may also have a curved or stepped profile depend on the profile of hinge side jamb 30. When the body 10 is in the fully extended position (FIG. 9) recessed portion 100 receives the part of the non-recessed portion 108 of hinge side jamb 30 extending the length between edge 110, defined by the intersection of non-recessed portion 108 and sidewall 112 connecting recessed porton 114 with non-recessed portion 108, and the vertical axis 116 about which door stop hinge plates 21 and 22 rotate. The embodiment of FIGS. 7–11 greatly relieves stress upon hinge 26 and the connection between hinge side jamb 30 and hinge plate 22.

Figure 11:
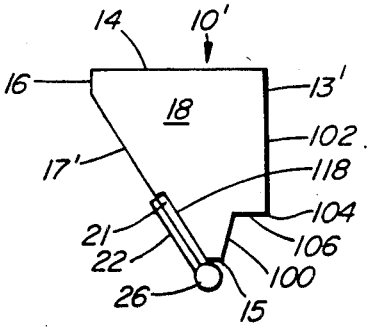
FIG. 11 is a view similar to that of FIG. 8 showing a third embodiment of the present invention.

As shown in FIG. 11, hinge plate 21 may be fastened within recess 118 on side 17' of block 10'. Of course, the same arrangement shown in FIG. 11 for hinge plate 21 may be accomplished using block 10 of FIGS. 1–6.

The hinge of the door stop advantageously is made of materials such as stainless steel.

The body 10 shown in the Figures is provided with relatively sharp corners and is of the shape of a prism of a generally right-angled triangular cross-section, including a first, second and a third side, all the sides being generally vertical and being so arranged that the extended position the first side is proximate the hinge-side jamb and the second side forms the surface section, the first side and the second side being at generally right angles relative to one another. Alternatively, the body may have rounded edges. Moreover, body 10 may be of any convenient shape. For example, the body can be of square or rectangular cross section.

I claim:

1. In combination:

(a) a rectangular door frame assembly including a hinge-side jamb and a latch-side jamb;

(b) a door panel including a first face, an opposed second face, two opposed upper and lower edges, a hinge edge and a latch edge, said edges being of a width corresponding to the thickness of said panel;

(c) door hinge means securing said door panel to said hinge-side jamb for pivotal movement about a generally vertical first axis from a fully closed position at which the panel is generally parallel with the plane defined by the frame, to a fully opened position at which the door panel is at about right angles to said plane;

(d) a door stop comprising a door engaging member hingedly secured to said hinge-side jamb by a door stop hinge for pivotal movement about a generally vertical second axis spaced from said first axis, from an extended position wherein a surface section of said door engaging member abuts against said hinge edge when the door panel is in said fully opened position, to a retracted position wherein the door engaging member is remote from the adjacent face of the door panel when the door panel is in said fully closed position;

(e) the door engaging member being of the shape of a prism of a generally right-angled triangle cross-section, including a first, a second and a third side, all sides being generally vertical and being so arranged that in said extended position said first side is proximate said hinge-side jamb and said second side forms said surface section, the first side and the second side being at generally right angles relative to one another;

(f) said hinge side jamb including a non-recessed portion and a first recessed portion adapted to receive said hinge edge when said door is in said fully closed position, said recessed section being closer to said door hinge than said generallly vertical second axis, and an edge defined by said non-recessed portion and a sidewall connecting said recessed portion to said non-recessed portion;

said first side having a second recessed portion, adapted to receive the non-recessed portion of said hinge side jamb, which rests between said generally vertical second axis and said first recessed portion when said door engaging member is in said extended position.

2. The combination of claim 1, wherein said door stop hinge is disposed in a general coincidence with a corner between the first side and the third side, whereby the axis of said door stop hinge is generally coincident with the surface non-recessed portion of the hinge-side jamb.

3. The combination of claim 1, wherein the door stop is so dimensioned that when it assumes the extended position, its contour as viewed in the direction of passage through said door is within the contour defined by the hinge edge when the door panel is in the fully opened position, whereby the passage through the door frame is not obstructed by the door stop.

* * * * *